United States Patent [19]

Laxmanan et al.

[11] Patent Number: 4,807,693

[45] Date of Patent: Feb. 28, 1989

[54] CHILL ROLL CASTING OF METAL STRIP

[75] Inventors: Venkatasubramanian Laxmanan, Rocky River, Ohio; Santosh K. Das, Randolph; Chin-Fong Chang, Lake Hiawatha, both of N.J.

[73] Assignee: Allied-Signal Inc., Morris Township, Morris County, N.J.

[21] Appl. No.: 940,666

[22] Filed: Dec. 11, 1986

Related U.S. Application Data

[62] Division of Ser. No. 545,569, Oct. 26, 1983, Pat. No. 4,649,983.

[51] Int. Cl.[4] ..... B22D 11/16

[52] U.S. Cl. ..... 164/452; 164/463

[58] Field of Search ..... 164/463, 479, 481, 482, 164/423, 429, 432, 433, 452, 154

[56] References Cited

U.S. PATENT DOCUMENTS 359,348 3/1887 Daniels ..... 164/433

4,202,404 5/1980 Carlson ..... 164/429

4,506,725 3/1985 Bedell ..... 164/463

*Primary Examiner*—Richard K. Seidel

*Attorney, Agent, or Firm*—Gus T. Hampilos

[57] ABSTRACT

A method for reliably casting a continuous metal filament employing a moving casting surface and means for depositing a stream of molten metal onto the casting surface to form the filament. A flexible, metallic mesh hugger belt, at least a portion of which is adapted to move at a velocity substantially equal to the velocity of the casting surface, entrains the filament against the casting surface to maintain cooling contact therewith and provides an entraining, hugger pressure which is sufficient to substantially prevent relative movement of the filament with respect to the casting surface and hugger belt. The hugger belt is also controlled to provide a hugger pressure sufficient to prevent the imposition of excessive forces within the filament during the cooling thereof.

3 Claims, 15 Drawing Sheets

FIG. 1
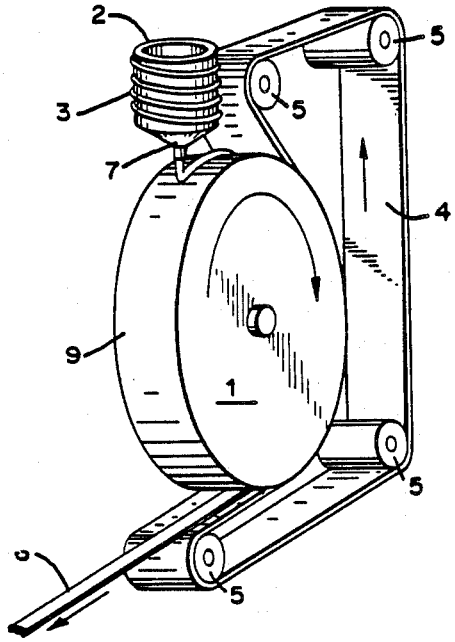
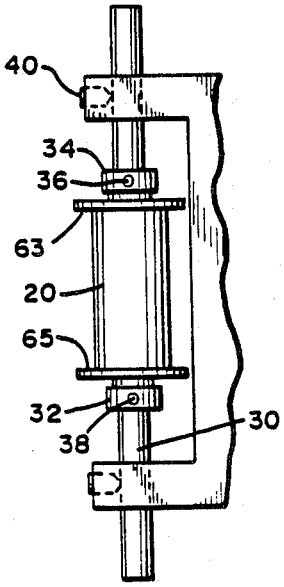
FIG. 4

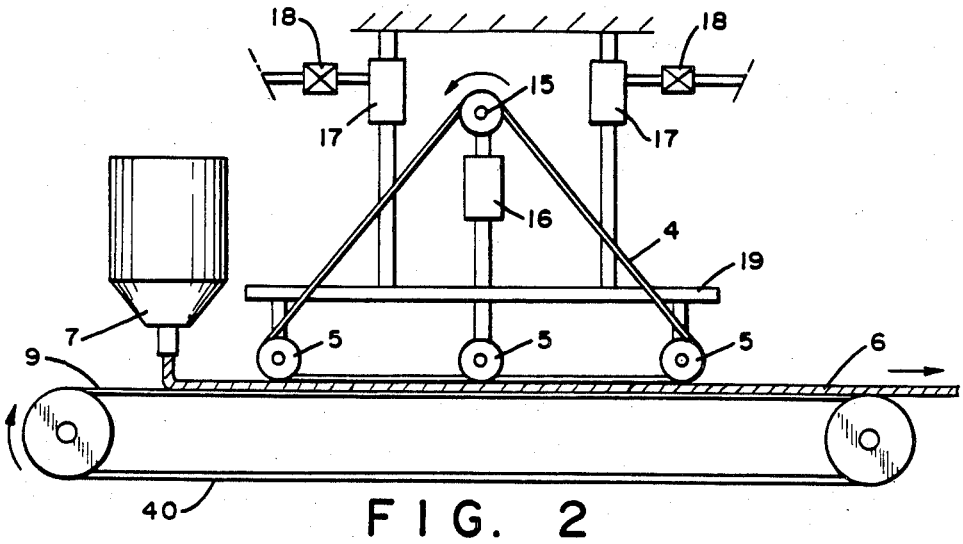
FIG. 2
FIG. 5
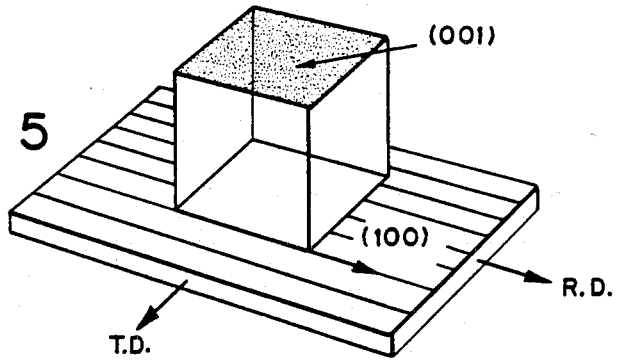
FIG. 6
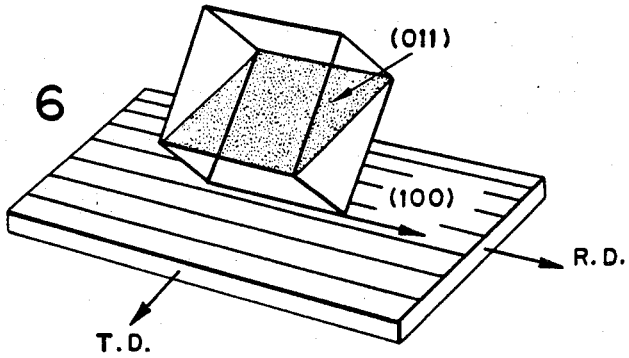

STEEL SUBSTRATE (200) POLE FIGURE

STEEL SUBSTRATE (110) POLE FIGURE

STEEL SUBSTRATE (200) POLE FIGURE

STEEL SUBSTRATE (110) POLE FIGURE

Cu-Be SUBSTRATE (200) POLE FIGURE

Cu-Be SUBSTRATE (110) POLE FIGURE

Cu-Be SUBSTRATE (200) POLE FIGURE

Cu-Be SUBSTRATE (110) POLE FIGURE a
e
TD
RD b
45° c

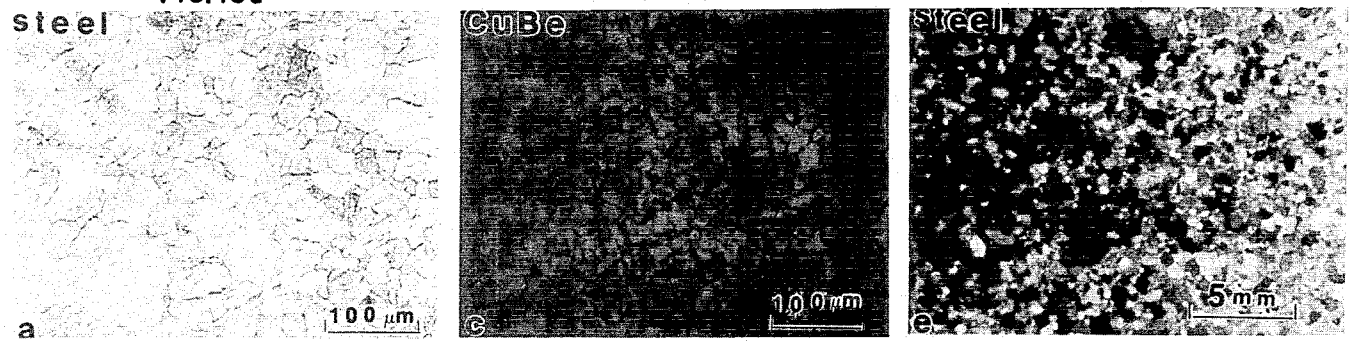
As Cast
FIG. 13a
FIG. 14a
Annealed
FIG. 15a
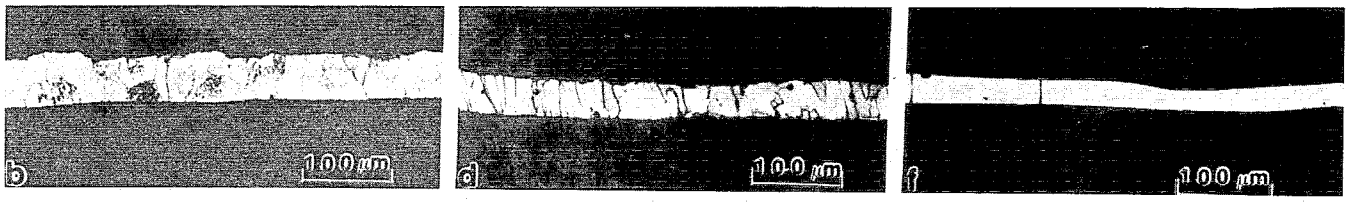
FIG. 13b
FIG. 14b
FIG. 15b

CHILL ROLL CASTING OF METAL STRIP

This application is a division of application Ser. No. 545,569, filed Oct. 26, 1983, now U.S. Pat. No. 4,649,983.

DESCRIPTION

1. Field of the Invention

This invention relates to the casting of metals and metal alloys by a melt spin process wherein a stream of molten metal is deposited on the peripheral surface of a rotating annular chill roll.

2. Description of the Prior Art

In the manufacture of metal filaments, such as metal ribbon and sheet, a stream of molten metal is directed against or otherwise deposited on a moving quench surface, whereon it is solidified and then separated or flung away by action of centrifugal force. Conventional casting systems of this type generally employ a quench surface furnished by a rotating chill roll, and are suitable for forming filaments of metals which possess sharp melting points, that is, metals which have very narrow solid-liquid transition temperature ranges of about 4°–6° C. However, certain amorphous, glassy metals and certain crystalline metal alloys have very broad transition temperature ranges which sometimes exceed 100° C. Such metals require prelonged contct with the chill roll to effect satisfactory quenching.

Conventional casting systems, however, tend to prematurely fling the filament away from the chill roll, and the point of filament separation from the surface of the chill roll varies, making it difficult to collect the filament and guide it to a suitable winder. In addition, the premature separation reduces the cooling rate of the cast filament and allows excessive oxidation on the filament surfaces.

The problems of inadequate filament retention on the surface of the chill roll and variable point of filament separation from the chill roll are only partially addressed by the conventional devices. U.S. Pat. No. 3,856,074 to Kavesh involves retention of filaments formed on the exterior surface of a rotating chill roll by use of nipping means. U.S. Pat. No. 3,862,658 to Bedell involves prolonging the period of contact between the filament and the chill roll by exerting a force agaisnt the surface of the chill roll, directed radially toward the axis of rotation thereof, by devices such as gas jets, moving metal belts and rotating wheels. In a specific embodiment, Bedell employs a metal belt of beryllium copper running over two rollers to confine the ribbon and prevent early separation from the chill roll.

Wheel-and-band type metal casting machines for continuous casting of metallic strip, deposit molten metal into the cavity formed between a grooved casting wheel and a retaining band moving together with the casting wheel. Such machines may employ a plurality of guide and/or drive wheels for the retaining band, and may employ a casting wheel having a series of equidistant studs or cores protruding into the casting cavity to produce perforated strip product.

U.S. Pat. No. 4,202,404 to Carlson discloses an elastomeric flexible belt carried in frictional engagement with the peripheral surface of a rotating annular chill roll. The elastomeric belt is supported by at least three rollers and urges a filament cast on the chill roll into prolonged contact therewith. Elastomeric belts, however, cannot withstand operating temperatures greater than about 400° C. The metal belts, such as those disclosed by Bedell, can withstand higher temperatures but lack durability and thermal stability. The thermal stresses induced during the casting operation have caused the belt to buckle, deform and break prematurely. Due to the thermal characteristics of the belt, the cast filament has been discontinuous and fragmented along its legnth and has had non-uniform cross-section.

In addition, conventional devices lack means for adequately preventing relative movement of the nascent cast filament with respect to the quench surface. Such relative movement, either laterally or longitudinally, can fragment a nascent filament because the nascent, hot filaments have reduced tensile and shear strengths at their elevated solidus temperatures. Even though the filament has been quenched to a solid, substantially non-viscous state, it may lack sufficient tensile or shear strength to withstand stresses imposed by the entrainment thereof between the casting surface and a flexible belt.

Thus, conventional casting devices using elastomeric or continuous sheet metal belts have lacked sufficient durability, thermal resistance or thermal stability needed to reliably maintain cooling contact between a high temperature, continuous metal filament and a quenching surface. Conventional devices have also not adequately prevented relative movement of the nascent filament with respect to the casting surface and belt. As a result, cast filaments have been fragmented and of non-uniform cross-section, and have had excessive oxidation on the surfaces thereof.

Prior devices have been employed to produce various crystalline metal alloys, such as FeSi alloys. In particular, FeSi alloys containing 6–7 wt % Si have been especially desirable because they exhibit high permeability, high saturation magnetization, low magnetostriction, and low power loss. However, these high silicon alloys have poor ductility and are difficult to fabricate into thin sheets that can be stamped or wound into desired shapes. Attempts to improve the ductility have been made by rapid quenching techniques and a large body of literature has been published on magnetic properties of rapidly quenched iron-high silicon (4–7 wt %) alloy. In these studies emphasis has been placed on reducing the coreloss through annealing treatments, and by cold rolling and annealing. While low coreloss values have been achieved, the magnetic properties are anisotropic; the properties are best along the longitudinal direction of the ribbon because of the inherent texture in the metal.

As a result, such FeSi materials are not well suited for use in rotating electromagnetic devices where the magnetic fields are constantly changing direction.

SUMMARY OF THE INVENTION

The invention provides an apparatus and method for reliably casting a continuous metal filament with substantially uniform dimensions and physical properties. The apparatus includes a moving casting surface and an extrusion means for depositing a stream of molten metal onto the casting surface to form the filament. A metallic mesh hugger belt, at least a portion of which is adapted to move at a velocity substantially equal to the velocity of the casting surface, entrains the filament against the casting surface to maintain cooling contact therewith. Force means, for urging the hugger belt toward the filament and casting surface, provide an entraining, hugger pressure which is sufficient to substantially prevent relative movement of the filament with respect to the casting surface and hugger belt. Regulator means control the hugger pressure to prevent the imposition of excessive forces within the filament during the cooling thereof.

In accordance with the invention, there is also provided a method for continuously casting metal filament. A stream of molten metal is extruded onto a moving casting surface to form the filament, and the filament is entrained against the casting surface to maintain cooling contact therewith. The filament is urged against the casting surface under an entraining hugger pressure which is sufficient to substantially prevent relative movement of the filament with respect to the casting surface, and the hugger pressure is controlled to prevent the imposition of excessive stresses within the filament during the cooling thereof.

Compared to conventional devices and procedures employing elastomeric belts or sheet metal belts, the invention more reliably casts continuous filament composed of alloys with very high melting points. The metallic mesh hugger belt is more durable, produces a more uniform cooling of the filament and better avoids discontinuities in the filament. Compared to devices without regulator menas for controlling stresses within the nascent filament, the invention more efficiently casts continuous metal filament having less oxidation, more uniform dimensions and improved physical properties, such as improved magnetic properties.

The apparatus and method of the invention are particularly useful for casting continuous filament of crystalline Co, Ni and Fe ferromagnetic alloys, such as FeSi alloys. The as-cast filament has consistent, uniform quality and be processed to produce filament having distinctive ferromagnetic properties, including distinctive permeability and coercivity. Such properties are particularly useful for constructing rotating electromagnetic devices, such as electric motors and generators.

When the apparatus and method of the present invention are employed to produce crystalline FeSi metal filament containing about 1 wt % to about 10 wt % Si, the crystal grains within the filament have a columnar structure in which the columnar grains are oriented substantially perpendicular to the plane of the cast filament with substantially no second phase particles at the grain boundaries. Additionally, the filament has a low surface roughness and is substantially free of surface oxidation. Such filament is distinctively suited for further processing to produce improved, isotropic ferromagnetic properties within the plane of the filament.

Thus, in accordance with the present invention, there is provided a method for forming a filament of FeSi metal having substantialy isotropic ferromagnetic properties within the plane of the filament. Generally stated, the method includes the step of forming a crystalline filament of FeSi metal. The filament has a columnar grain structure oriented substantially normal to the plane of the strip and substantially no second phase particles at the grain boundaries thereof. The filament is then pickled in an acid solution and annealed to provide a filament having a <100> fiber texture wherein the intensity of grains having their <100> crystal direction oriented in a direction substantially normal to the plane of the filament is at least 2 times random.

The present invention further provides an improved crystalline filament consisting essentially of FeSi metal having substantially isotropic ferromagentic properties within the plane of the filament. The filament has a <100> fiber texture wherein the intensity of grains having their <100> crystal direction oriented in a direction substantially normal to the plane of the filament is at least about 2 times random.

BRIEF DESCRIPTION OF THE DRAWINGS

FIG. 1 illustrates the use of a hugger belt apparatus in connection with a chill roll casting apparatus;

FIG. 2 illustrates an embodiment of the invention wherein the casting surface is provided by an endless casting belt;

FIG. 4 shows an isometric view of a guide wheel assembly.

FIG. 5 illustrates a strip having cube texture;

FIG. 6 illustrates a strip having Goss texture;

FIG. 13(*a*),(*b*) show the microstructure of a Fe-Si strip cast on a steel substrate;

FIG. 14(*a*),(*b*) show the microstructure of a Fe-Si strip cast on a Cu-Be substrate; and FIG. 15(*a*),(*b*) show the microstructure of a Fe-Si strip cast on a steel substrate after annealing.

DESCRIPTION OF THE PREFERRED EMBODIMENTS

Figure 3:
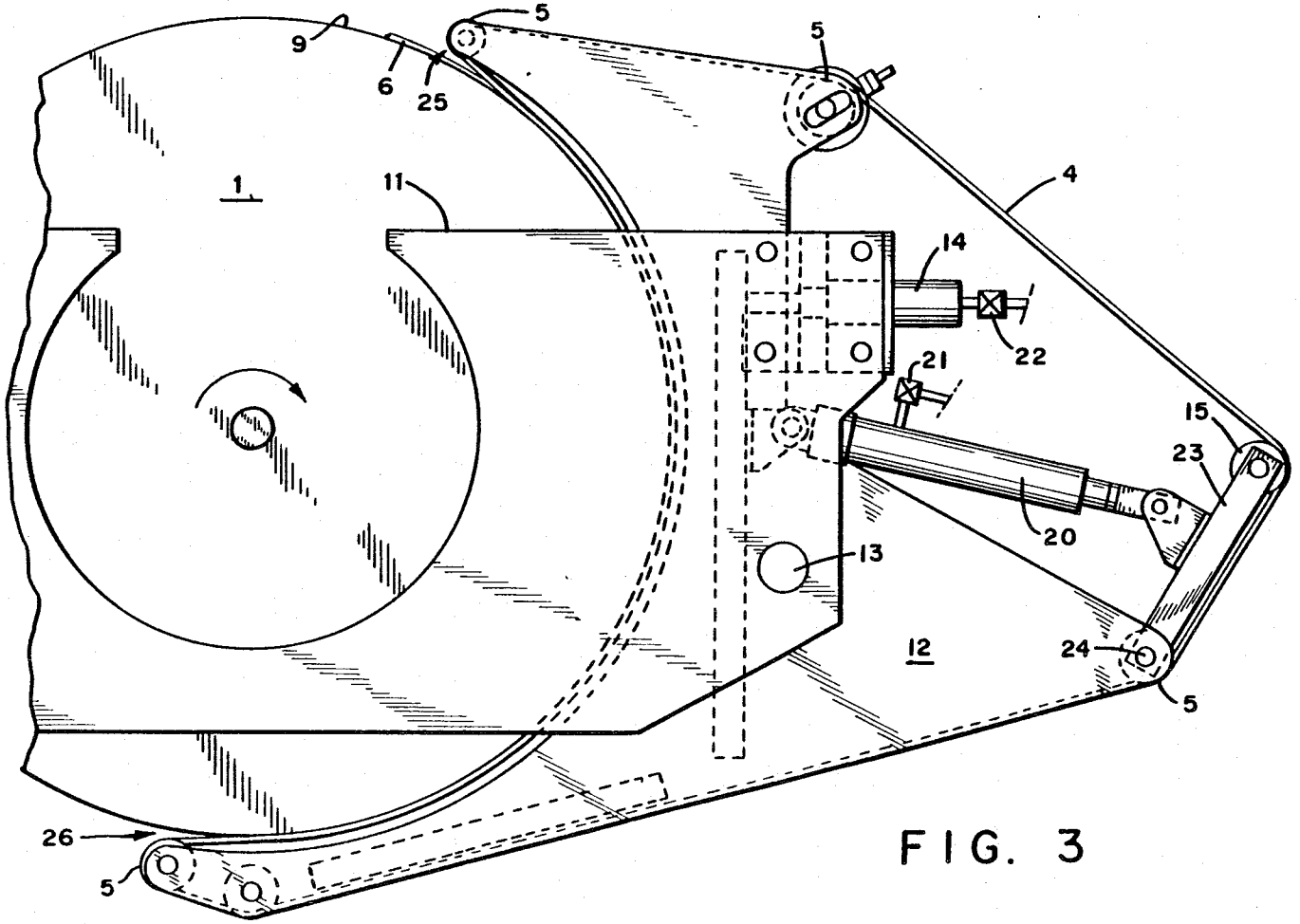
FIG. 3 shows a side elevation view of an embodiment of the invention wherein the casting surface is provided by a chill roll.

For purposes of the present invention and as used in the specification and claims, a filament is a slender body whose transverse dimensions are much less than its length. Such filaments may be bodies such as ribbons, strips, or sheets, both narrow and wide and of regular or irregular cross-section. Also, for the purposes of the present invention, a belt is an endless strip of flexible material, and a roll is a substantially cylindrical structure.

FIG. 1 illustrates in representative form the operation of the present invention. A casting chill roll 1 rotates to provide a peripheral speed ranging from about 100–4000 m/min., and a container 2 equipped with induction heating coils 3 holds molten metal alloy. An extrusion means 7 deposits molten metal onto a moving, casting quench surface 9 of the rotating casting roll 1 whereon it solidifies into filament 6. A metallic mesh hugger belt 4 is supported by guide wheels 5, and at least a portion of the belt moves codirectionally with the rotating roll 1 to retain the filament 6 against the casting roll. Where belt 4 is wider than filament 6, it is carried in direct contact and in frictional engagement with the peripheral surface of casting roll 1. Belt 4 entrains the filament along an arcuate chill roll portion, which subtends an angle of at least about 120°, to hold the filament in contact with the casting surface. Auxiliary equipment, including at least three guide wheels 5, guide and position the belt into the desired contact with the annular chill roll.

FIG. 2 shows a schematic representation of an embodiment of the invention wherein a chilled, endless casting belt 40 provides a moving casting surface 9. A metallic mesh hugger belt 4 is supported by guide wheels 5 and 15, and at least a portion of belt 4 moves codirectionally with an adjacent portion of casting belt 40 to entrain and hold filament 6 in cooling contact with the casting surface. The velocity of belt 4 substantially equals the velocity of the adjacent portion of casting belt 40. Where belt 4 is wider than filament 6, it is carried in direct contact and in frictional engagement with the adjacent surface of casting belt 40. A tensioning means such as actuator 16 moves guide wheel 15 outwardly to regulate the tension in belt 4. Force means comprised of actuators 17 move a displacement member 19, which is adapted to urge belt 4 toward filament 5 and casting surface 9 to provide an entraining, hugger pressure. This hugger pressure is sufficient to substantially prevent relative movement of the filament with respect to the casting surface and hugger belt. Regulator means 18 control the hugger pressure to prevent the imposition of excessive stresses within filament 6 during the cooling thereof.

FIG. 3 illustrates a preferred embodiment of the invention wherein a rotatable chill roll 1 provides a moving casting surface 9. A metallic mesh hugger belt 4 is supported by guide wheels 5 and 15, and at least a portion of belt 4 is adapted to move at a velocity substantially equal to the velocity of casting surface 9 to engrain filament 6 against the casting surface to maintain cooling contact therewith. A force means is comprised of a displacement member, such as actuator frame 12, and actuator means, such as pneumatic actuator 14. The force means urges hugger belt 4 toward filament 6 and casting surface 9 to provide an entraining, hugger pressure which is sufficient to substantially prevent relative movement of the filament with respect to the belt and casting surface. Regulator means comprised of regulator values 21 and 22 connected to pneumatic actuators 20 and 14, respectively, control the hugger pressure to prevent the imposition of excessive stresses with in filament 6 during the cooling thereof.

Chill roll 1 is of conventional construction, and the peripheral surface of the chill roll, which provides the actual quench surface, is composed of a material having sufficient strength, thermal stability and high thermal conductivity. Preferred materials of construction for the chill roll include, for example, beryllium-copper, oxygen-free copper, low carbon steel and stainless steel. To provide protection against corrosion, erosion or thermal fatigue, the peripheral surface of the chill roll may be coated with a suitable resistant or high melting point coating; for example, a ceramic coating or a coating of corrosion resistant metal, such as chrome, may be applied by known procedures.

The molten metal from which filament 6 is formed is deposited onto the peripheral surface of the chill roll by a suitable extrusion means. One suitable method, illustrated in FIG. 1 of the drawings, involves heating the metal, preferably in an inert atmosphere to a temperature at least about 50° to 100° C. above its melting point. Pressurization of container 2 with an inert gas extrudes molten metal through a nozzle 7 onto the chill roll 1. After deposition on the casting surface, the molten metal is rapidly quenched and solidified to form a filament 6.

In casting metal filament of certain compositions, it is desirable to prolong the contact time between the filament and the surface of the chill roll to obtain adequate quenching. Also, when casting filaments of glassy metal alloys or crystalline metal alloys which require extremely rapid quench rates of at least about $10^{4}$° C./sec, the surface of the rotating chill roll moves at very high speeds, typically at least about 25 m/sec. This generates high centrifugal forces which tend to fling the filament away from the casting surface causing premature separation which frequently results in filaments that are unevenly quenched and not dimenionally or structurally uniform. In addition, when a hot, nascent filament is captured and held against the cooled casting surface by a conventional hugger belt systems, undesirable stresses can be imposed on the filament. At elevated temperatures near the solidus temperature the tensile and shear strengths of certain metals can be significantly reduced. The hot filament may be unable to withstand the stresses induced by the hugger belt, and may fracture.

FIG. 3 illustrates a preferred hugger belt system which ensures proper quenching and also minimizes stresses in the nascent, hot filament. The system includes a support frame 11 and a displacement member, such as actuator frame 12. The frames are made of any suitable material having sufficient strength and durability, for example, stainless steel type 304. Support frame 11 is generally comprised of two parallel plates which support actuator frame 12, therebetween. Actuator frame 12 pivotably mounts in support frame 11 on shaft 13.

A first actuator, such as pneumatic actuator 14, mounts on support frame 11 and operably connects to actuator frame 12 to selectively rotate frame 12 about shaft 13. The rotation of frame 12 urges hugger belt 4 toward filament 6 and casting surface 9 to provide an entraining hugger pressure which is sufficient to substantially prevent movement of the filament relative to the belt and casting surface. Actuator frame 12 is preferably adapted to rotate in a direction which accentuates the movement of the entry portion 25 of the hugger belt system toward casting surface 9 compared to the movement of exit portion 26. To accomplish this, actuator 14 connects to frame 12 at a pont which directs the actuator force along a line passing between shaft 13 and belt entry portion 25. This configuration ensures that adequate hugger pressure is provided at the belt entry portion.

In addition, the point of initial contact of belt 4 with casting surface 9 is adjusted to delay contacting the nascent filament until it has cooled and developed sufficient strength to withstand the process of entrainment between the belt and casting surface. If contact is made too soon, the hot filament may break; if contact is delayed too long, the filament may leave the casting surface and miss the entry portion 25.

The amount of hugger pressure should be carefully controlled. It has been discovered that even though there may be no discernable slippage between belt 4 and casting surface 9, the hugger pressure may be insufficient to prevent the development of excessive stresses in the hot, nascent filament which causes breakage. Surprisingly, an increased hugger pressure reduces filament breakage. While not intending to be bound by any particular theory, the increased hugger pressure appears to provide a more intimate contact of the filament with the hugger belt and the casting surface. This closer contact provides faster heat transfer from the hot filament; i.e. better cooling; and allows a more rapid increase in filament strength. The stronger filament better resists the stresses induced by the entrainment process.

A tensioning means is comprised of tensioning arm 23 and a second actuator, such as pneumatic actuator 20. Tensioning arm 23 supports wheel 15 and pivotably connects to the actuator frame to rotate about shaft 24. Pneumatic actuator 20 is mounted on actuator frame 12, and is operably connected to move and rotate arm 23. The rotation moves wheel 15 into contact with belt 4 and produces a selected tension therein. Pressurized gas is supplied through regulator valves 22 and 21 to operate actuators 14 and 20, respectively. By regulating the gas pressure provided to the actuators, the configuration advantageously controls the hugger pressure to prevent the imposition of excessive stresses within filament 6 during the cooling thereof by casting surface 9 and belt 4.

A guide means can be attached to one or more of the guide wheels to align the belt on the wheel. Such guide means can be provided by flanges attached to at least one of the guide wheels. For example, in FIG. 4, shaft 30 supports guide wheel 20 and allows rotation thereon. Guide wheel 18 has flanges 63 and 65 which align the belt therebetween. Collars 32 and 34 position guide wheel 18 on shaft 30, and set screws 36 and 38 fix the position of collars 32 and 34 along the length of the shaft 30.

Belt 4 is carried over at least three guide wheels 5 supported by actuator frame 12. Two guide wheels position the belt in contact with the chill roll over the desired arc distance. The third, and possibly additional guide wheels, prevent contact between that part of the looped belt moving counter-directionally to that portion of the belt moving in contact with the chill roll surface by constraining the path of the counter-directional part of the belt to an area removed from the chill roll. The use of at least three guide wheel positions the belt to retain the filament in contact with an arcuate portion of the rotating chill roll which subtends an angle ranging from about 120° to 320° and preferably ranging from about 150° to 240°.

When casting filament from alloys extruded at temperatures exceeding about 1450° C., elastomeric belts have proven unsuitable because they cannot withstand temperatures greater than about 400° C. and will degrade or burn up. Flexible sheet metal belts have also proven unsuitable because belts thin enough to have the required flexibility will buckle under the thermal stressed induced during casting. In addition, the sheet metal belts are unable to dissipate heat quickly enough to avoid weakening caused by the heat absorbed during the casting operation. The sheet metal belt may become too weak to support and maintain the belt tensions needed to produce the required levels of hugger pressure against filament 6 and casting surface 9.

Woven, metallic wire mesh belts are flexible and strong enough to withstand the high casting temperatures, but past experiences had indicated that the textured weave belt surface would leave impressions on the casting surface of the chill roll and on the surfaces of the cast filament. Even when belts closely woven from thin wire of about 0.040 cm diameter were employed, residual impressions of the belt weave could be discerned on the casting surface. Ordinarily, such impressions would degrade the surface finish and quality of the filament. It was surprisingly discovered, however, that during actual casting, the surfaces of the cast filament were not degraded by the texture of the belt weave; the filament surfaces remained smooth and were substantially unaffected by the weave pattern.

In addition, it was discovered that the woven belt more effectively dissipated heat absorbed from the hot filament and became substantially self-cooling. Even when the metallic mesh hugger belt was used to cast metal alloys with extrusion temperatures exceeding 1600° C., there was little or no heat discoloration of the belt. This contrasted markedly with the amount of heat discoloration observed on ordinary sheet metal hugger belts. As a result of its improved heat dissipation characteristics, the metallic mesh hugger belt better resisted buckling caused by the thermal stresses and provided more rapid and more uniform cooling of the cast filament. The cast filament was substantially free of surface oxidation.

In a preferred embodiment, the apparatus of the invention employs a metallic mesh belt woven from 0.040 cm diameter (16 mil gauge) stainless steel wire in weave patterns commonly referred to as a "cord-weave" and a "universal weave". Such belts are commercially available from Audubon Metal Wove Belts Corporation; Philadelphia, PA.

Preferably the metallic mesh hugger belt is driven by frictional engagement with casting surface 9. The mesh belt is sized to overlap filament 6 and to directly contact casting surface 9 along areas that are adjacent to the marginal portions of the filament. It is readily apparent, however, that separate mechanisms could be employed to drive the hugger belt and the moving chill body.

It has been discovered, however, that the amount of hugger pressure directed against filament 6 and surface 9 by mesh belt 4 is very important. A pressure which is adequate to establish a driving frictional engagement may not be adequate to operably cast continuous filament. If the hugger pressure is too low, the cast filament becomes fragmented due to excessive stresses induced therein during the process of entraining the filament between belt 4 and casting surface 9.

The minimum hugger pressure depends upon a number of factors including the alloy composition, the casting speed, the composition of the casting surface, the composition of the woven metallic mesh belt and the particular mesh weave pattern. For reliable operation, the hugger pressure is at least about 0.5 psi and preferably ranges from about 0.7 to 4 psi. In the particular embodiment illustrated in FIG. 3, actuator 14 has a $\frac{3}{4}$ inch diameter and is pressurized with a gas pressure which is at least 20 psi and preferably ranges from about 20 to 100 psi. More preferably, the pressure ranges from 50–70 psi. Similarly, actuator 20 has a $\frac{3}{4}$ inch diameter and is pressurized with a gas pressure of at least 20 psi. Preferably, the gas pressure in actuator 20 ranges from 20–100 psi, and more preferably, it ranges from 50–70 psi. The tension maintained in belt 4 should not exceed 10% of the belt strength to assure prolonged belt life.

The invention is suitable for casting crystalline metal filament, such as filaments composed of copper, aluminum, nickel, cobalt, iron or alloys thereof. In particular, the invention is useful for casting filament composed of iron-silicon (FeSi) alloy. These FeSi alloys have compositions consisting essentially of that defined by the formula $Fe_{90-99}Si_{1-10}$ expressed in weight percent. Preferably, the amount of silicon ranges from about 3–7 wt %, and more preferably the amount of silicon ranges from about 6–7 wt %. Such alloys are especially desirable because of their favorable magnetic characteristics, such as high permeability, high saturization magnetization, high curie temperature, low magnetostriction and low core loss. Such alloys are also inexpensive.

Considerable effort has been expended in the development of methods and approaches for casting an FeSi alloy containing about 6.5 wt % silicon. This particular alloy has extremely desirable ferromagnetic properties, but has poor mechanical properties; it ordinarily has poor ductility and is not easily formed into thin ribbons or sheets that can be stamped or wound into selected shapes. A metal filament is considered to be ductile if it can be bent around a radius of 10 times the filament thickness without fracture. Attempts to improve ductility have been made by partially substituting aluminum for silicon and by "direct drawing" filament from the melt into air at room temperature. In addition, thin filaments about 10–40 microns thick and about 1–2 mm wide have been formed by a melt spinning technique. In this technique, a stream of alloy is ejected through a nozzle and then rapidly quenched on the circumferential surface of a rapidly rotating disk to form a ductile ribbon. Conventional melt spinning apparatus, however, have not incorporated means for prolonging the contact of the cast ribbon with the casting surface. As a result, the finish quality and magnetic properties of the as-cast filament have been less consistent than is desired. In addition, the ribbons produced by the melt spinning technique have been very narrow, about 1–2 mm wide, and quite short, 5–10 mm in length.

The present invention, however, is capable of casting continuous filament of ductile, crystalline Co, Ni and Fe ferromagnetic alloys, such as FeSi alloy having about 6.5 wt % silicon. The as-cast filament is of consistent quality, and surprisingly can be processed to produce a material having distinctive ferromagnetic properties. The ferromagnetic properties are particularly advantageous when using the material to construct rotating electromagnetic devices, such as electric motors and generators.

While not intending to be bound by any particular theory, it is believed that the improved ferromagnetic properties of the processed filament are derived from the particular crystal grain structure produced within filament 6 by the apparatus and method of the invention. The extremely rapid quench rate, and the prolonged contact with the quench surface advantageously combine to minimize oxidation and produce substantially uniform, columnar crystal grains that can be selectively modified to produce material useful in rotating electromagnetic devices. Such grains are not consistently or uniformly formed in FeSi 6.5% alloy produced by conventional apparatus and methods, such as the spin melt process.

The apparatus and method of the present invention are also capable of producing wide and continuous filament. The filament produced has been at least about 0.7 cm wide and 1 meter in length. Typically, the filament has been at least 1.0 cm wide and 10 meters in length. The wider material is particularly advantageous for stamping out larger complex shapes, and the longer material is particularly advantageous for winding magnetic cores.

It is well known that single crystals of iron have a cubic crystalline structure and are most easily magnetized in the <100>, less easily magnetized in the <110> direction, and least easily magnetized in the <111> direction. This magnetic anisotropy has a strong effect on the static hysteresis loss of transformer cores during alternating magnetization. Thus, the rolling and annealing treatments applied in the production of transformer sheet steel are chosen to produce either a random texture to minimize the magnetic anisotropy or a strong texture in which as many grains as possible are oriented with their <100> direction parallel to the rolling direction.

The planes and directions are expressed in standard crystallographic notation. For example, for the orientation (001)[100], the [100] strip direction is along the length or rolling direction (RD) of the metal strip; the [010] direction is along the transverse width dimension (TD) of the strip; and the [001] direction is along the thickness dimension or the direction normal to the plane of the strip. FIGS. 5,6.

Two types of texture have been developed for oriented electrical steel sheet, cube texture and Goss texture. In cube texture the orientation can be described as (001) [100], that is, cube on face; FIG. 5. In the latter case, the orientation can be described as (011) [100], that is, cube on edge; FIG. 6.

Conventional grain oriented electrical steel for core laminations of power transformers has been a 3.5 wt % silicon steel treated to exhibit a very strong Goss texture in the form of a secondary recrystallized structure, produced by a complicated processing scheme that includes cold rolling and annealing.

In cores for rotating machines the magnetic field is in the plane of the sheet, but the angle between the field and the longitudinal direction of the sheet varies as the core rotates. Thus, in this case, it is not necessary to have the "easy" (most easily magnetized) direction in the longitudinal direction of the sheet and a satisfactory texture would be {100} <uvw>, which keeps the "hard" (most difficult to magnetize) <111> direction out of the plane of the sheet. A <100> "fiber" texture would be even better (i.e., a texture in which all grains have a <100> direction normal to the sheet surface and in all possible rotational positions about this normal) because the sheet would then have isotropic ferromagnetic properties in its own plane.

The term, texture, as used in the specification and claims hereof, means the predominate orientation of the crystal grains within the metal when compared to a reference sample having randomly oriented grain crystals. Texture can be determined by conventional techniques, such as X-ray diffraction and electron diffraction analysis.

The present invention provides a method of processing as-cast ribbons of Fe-Si alloy (preferably containing 6 to 7 wt % Si) to obtain a columnar grain structure with <100> fiber texture. This process includes pickling the ribbon in an acid bath and subsequent annealing in an oxygen limited atmosphere, such as in a vacuum or a hydrogren atmosphere. The resulting material has excellent soft magnetic properties (e.g. low powerloss and in-plane isotropy with respect to its ferromagnetic properties). A material has substantially isotropic ferromagnetic properties when its ferromagnetic properties, as determined by the B-H curve thereof, do not vary by more than 20% among the pertinent directions.

The growth of grains with particular orientation can be achieved by controlling (1) the matrix texture, (2) the surface energy and, (3) grain boundary impingement. The matrix texture imposes a selective growth inhibition which only allows certain grains to grow. Because of the special orientational relationships between an individual grain and its neighboring grains, certain grains can grow faster than the other grains. Surface energy affects grain growth because there are differences in surface energy at the gas-metal interface; those grains with the lowest surface energy are more likely to grow. Grain boundary impingements inhibit grain growth; because of impingements by isolated solute atoms, second phase particles or free surface drag effects, only those grains with size large enough to overcome the drag can grow.

In the present invention, the matrix texture and free surface drag effects in the as-cast strip are controlled by employing a selected casting substrate and apparatus, and by employing a selected casting substrate process. Then, to optimize the magnetic properties, the as-cast ribbons are given a surface treatment and annealed as follows:

(1) acid pickling in various solutions, preferably for 0 to 16 mins:
(2) surface coating with MgO;
(3) annealing in vacuum or hydrogen atmosphere, preferably at a temperature between 900° C. to 1200° C. for a time period of 5 mins to 17 hrs.

For annealing at temperatures of not more than 1000° C., step (2) may not be necessary.

Acid pickling introduces a differential drag among surface grains which inhibits the growth of certain matrix grains and promotes the growth of grains with desirable orientations. The degree of etching (acid attack) upon the grains strongly depends on its crystallographic orientation. This preferential attack produces a differential height which in turn, produces a differential drag among the grains. In the annealing process, those preferred grains with larger size and smaller drag will grow faster than other grains and thereby develop the desired texture. In addition, pickling helps in eliminating any oxide layer that may be present on ribbon surface as well as randomly nucleated grains that may be present in the chill zone of the ribbon that is close to the quenching substrate.

It is important to note, however, that the presence of an excessive oxide layer can significantly reduce the effectiveness of the acid pickling step. If there is excessive oxidation of the strip surfaces, the crystal grains exposed after the removal of the oxide layer will be of uneven height. The exposed grains having the undesired crystal orientations may be significantly higher than the exposed grains having the desired crystal orientations. As a result, the acid pickling step may not adequately inhibit the growth of the undesired grains to develop the desired fiber texture.

The MgO surface coating provides an insulation layer to prevent the ribbon from welding together by surface diffusion during annealing. In addition, the surface coating can introduce a tensile stress along the longitudinal direction of the ribbon which affects the grain orientation during annealing.

The annealing produces an optimum grain size and texture for better magnetic properties. The surface energy ($\gamma$) of the grains is a key factor in obtaining the desired texture, and by altering parameters such as furnace atmospheric pressure, the gas used, and composition of the alloy, the dominant secondary recrystallization component can be controlled. The (100) [001] grains preferentially grow when sufficient oxygen is present at the metal interface, making $\gamma_{100}$ the lowest. When a little or no oxygen (i.e. an oxygen-limited atmosphere) is present at the gas metal interface, $\gamma_{100}$ is the lowest and (110) [001] grains preferentially grow. When $\gamma_{100}$ and $\gamma_{110}$ are approximately equal but lowest among all the (h k l) surface energies, such as occurs in a hydrogen atmosphere, both (100) [001] and (110) [001] grains preferentially grow simultaneously. In addition, a hydrogren atmosphere is the most effective reducing agent to prevent high temperature oxidation and to help reduce interstitial impurities, such as carbon, in the Fe-Si alloy. Thus, a vacuum anneal and/or hydrogen anneal (1) provides the lowest surface energy to preferred grains with the desired orientation and causes those grains to grow, (2) prevents high temperature oxidation, and (3) removes the interstitial impurities in the material.

EXAMPLES

Figure 7A:
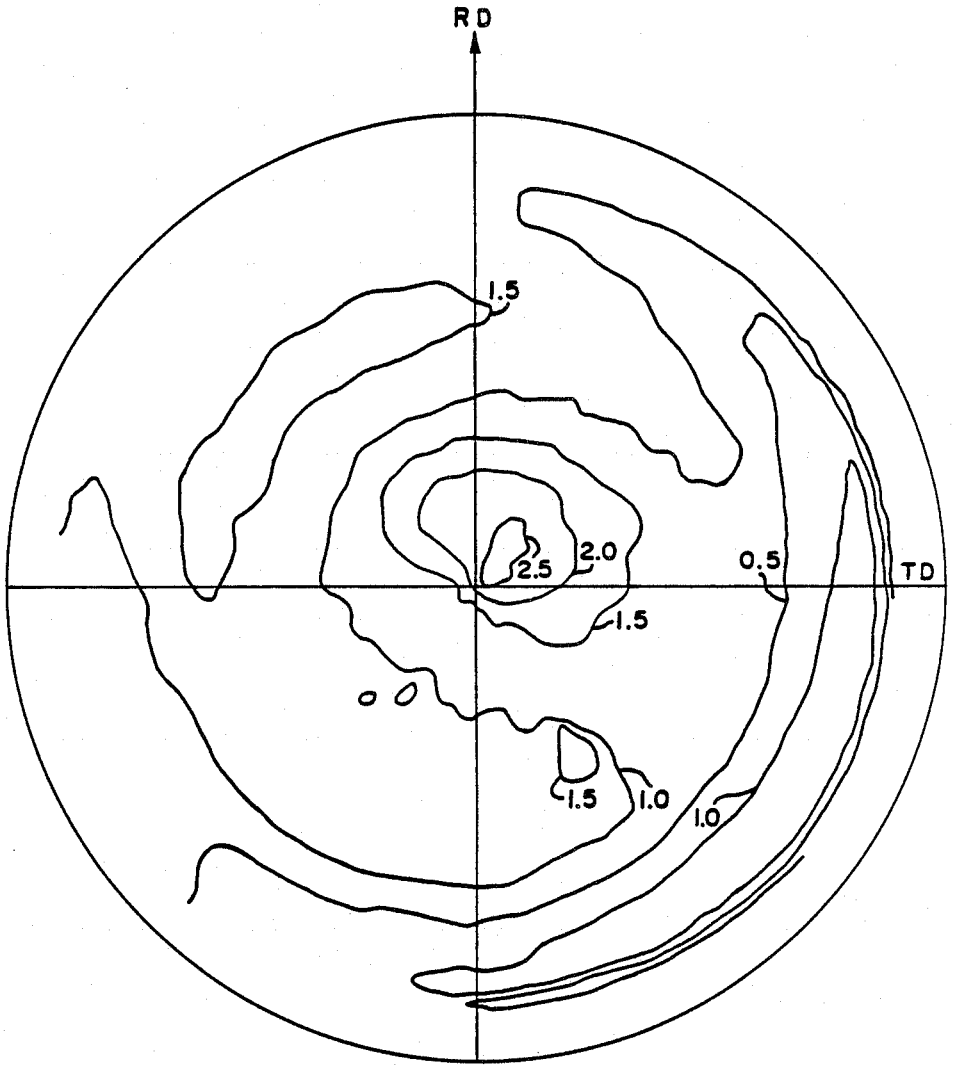
FIGS. 7(*a*),(*b*) show pole figures of an as-cast FeSi strip quenched on a steel substrate.
Figure 7B:
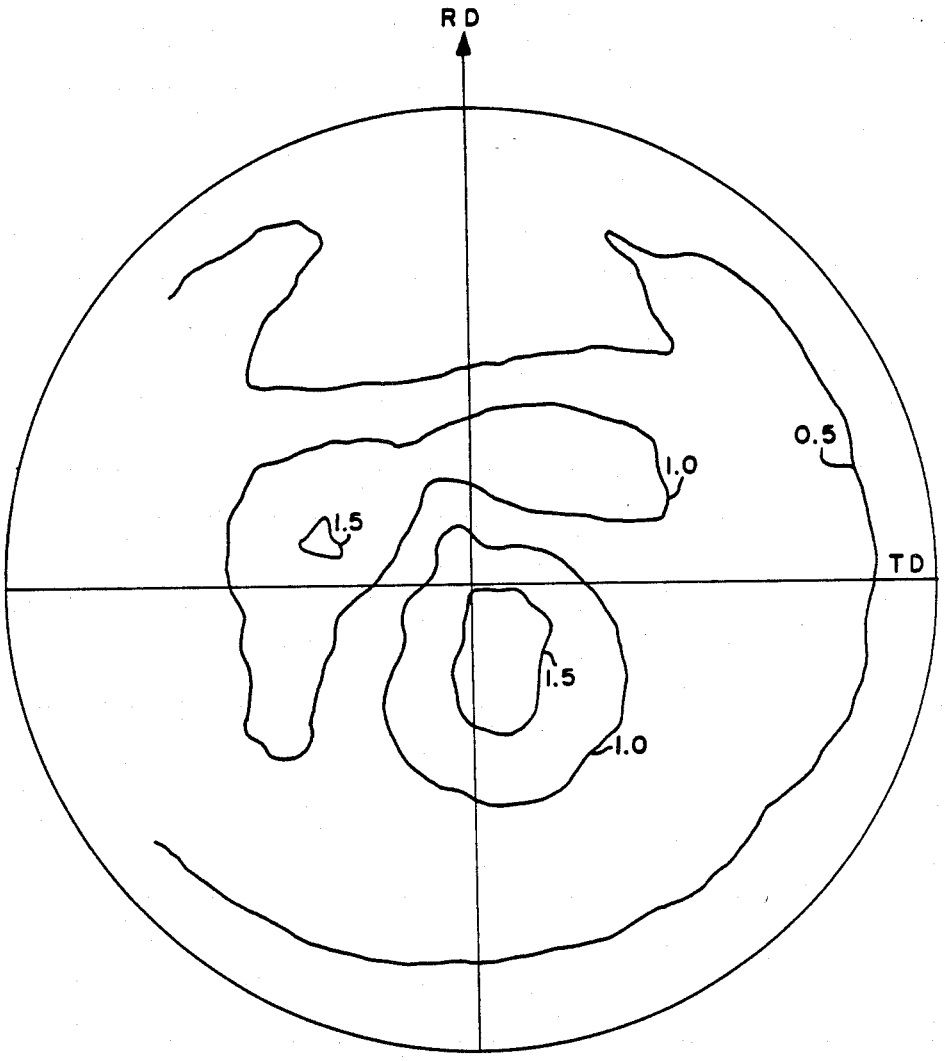

A strip of FeSi alloy containing approximately 6.5 wt % Si was cast on the apparatus of the present invention which is representatively shown in FIG. 3 hereof. The cast wheel had a low-carbon steel casting substrate and rotated to provide a peripheral casting surface speed of approximately 2500 fpm. A gas pressure of approximately 55 psi was supplied to the pneumatic actuators to tension the metallic mesh hugger belt. The as-cast strip had a 100% columnar grain structure with an average grain size of $2.3\times10^{-5}$m, and there were substantially no second phase particles at the grain boundaries, as shown in FIG. 13(*a*)(*b*). The strip had a near random texture, as representatively shown in the pole figure of FIGS. 7(*a*),(*b*).

Figure 8A:
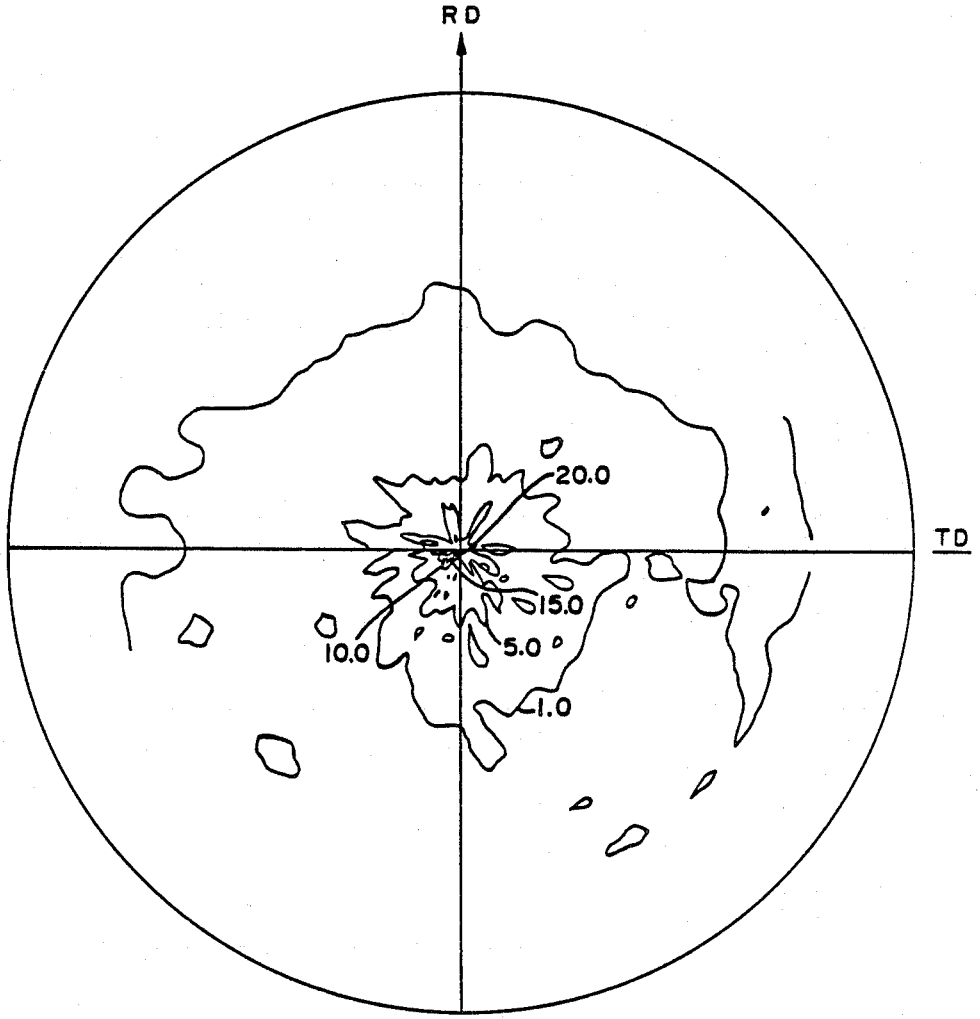
FIGS. 8(*a*),(*b*) show pole figures of a FeSi strip quenched on a steel substrate after pickling and annealing.
Figure 8B:
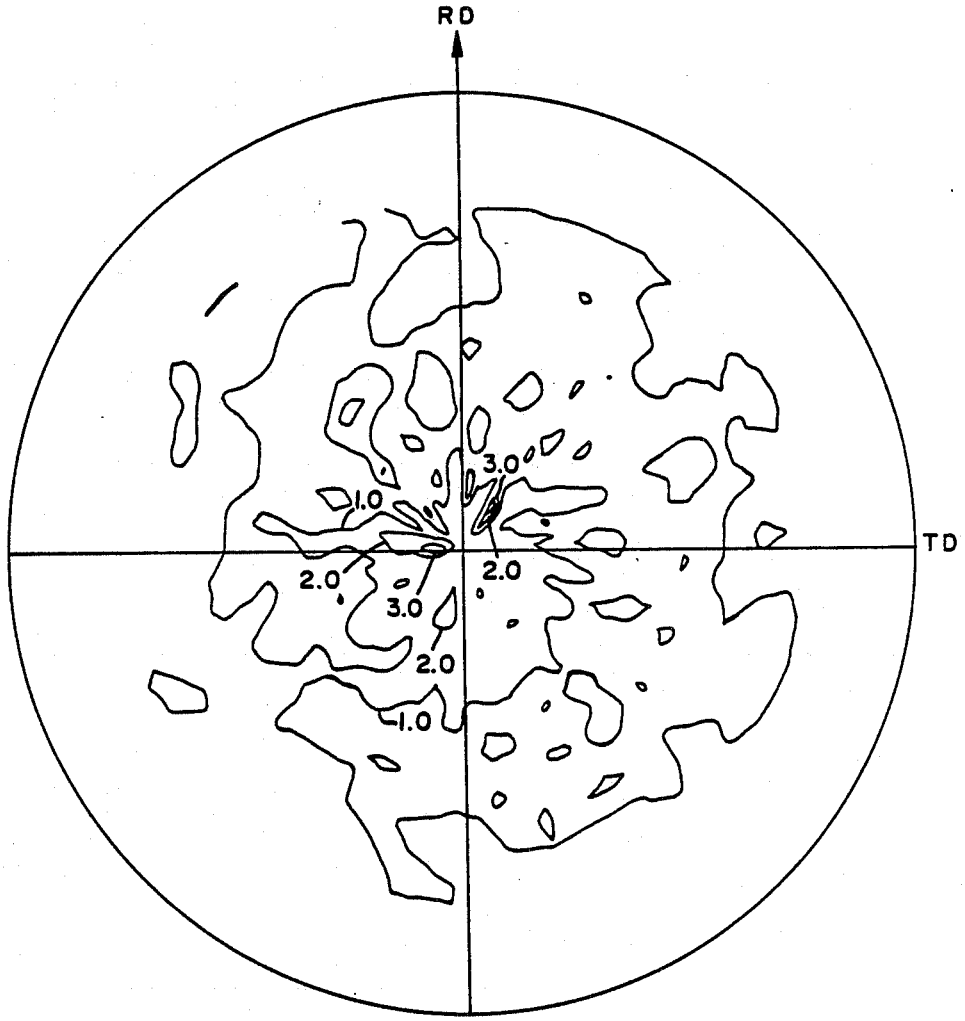

The material was pickled in 100% phosphoric acid for 4 min and annealed at 1000° C. for 4 hours in vacuum. As shown in FIG. 15(*a*),(*b*), the annealed sample had a columnar grain structure with average grain diameter of 1 mm, measured along the plane of the strip. The texture analysis using convention X-ray diffraction techniques (e.g. texture goniometer) showed a <100> fiber texture with an intensity of 20 times random normal to the plane of the ribbon ; FIGS. 8(*a*),(*b*).

Figure 9A:
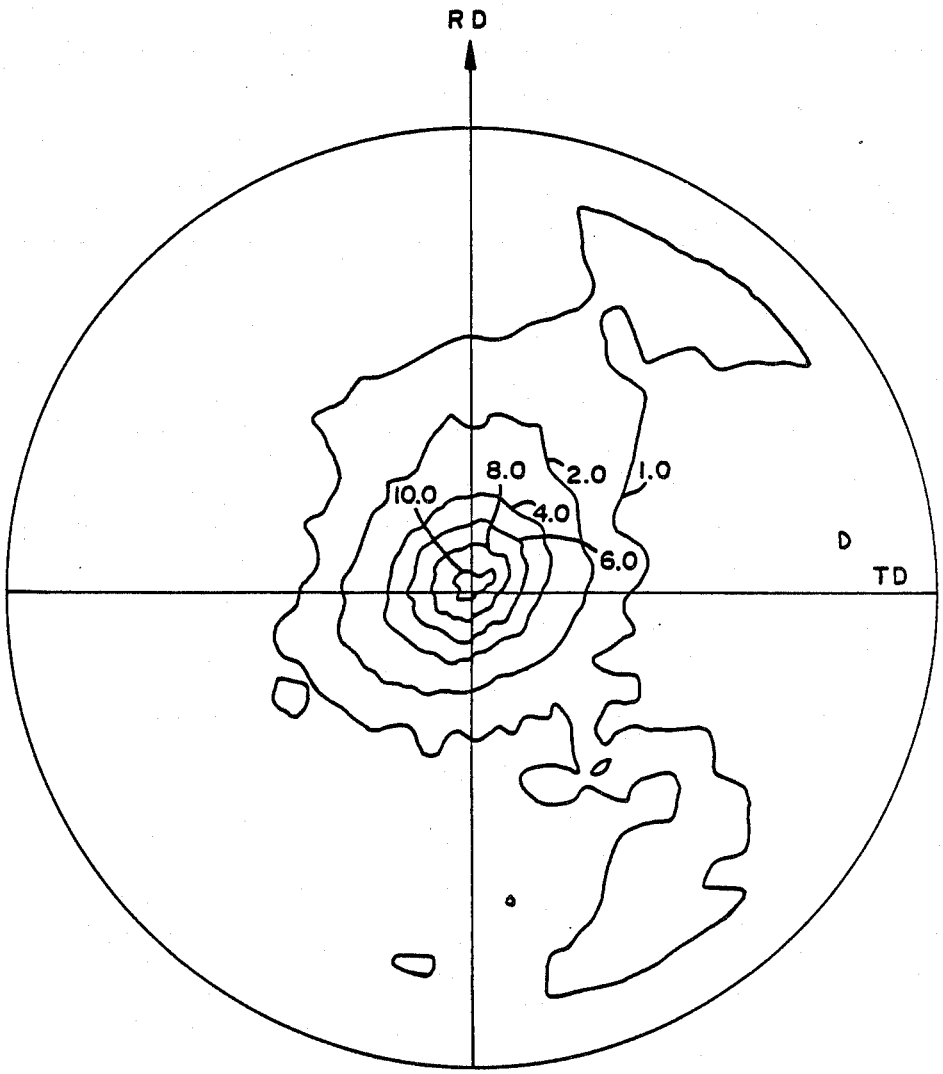
FIGS. 9(*a*),(*b*) show pole figures of an as-cast FeSi strip quenched on a Cu-Be substrate.
Figure 9B:
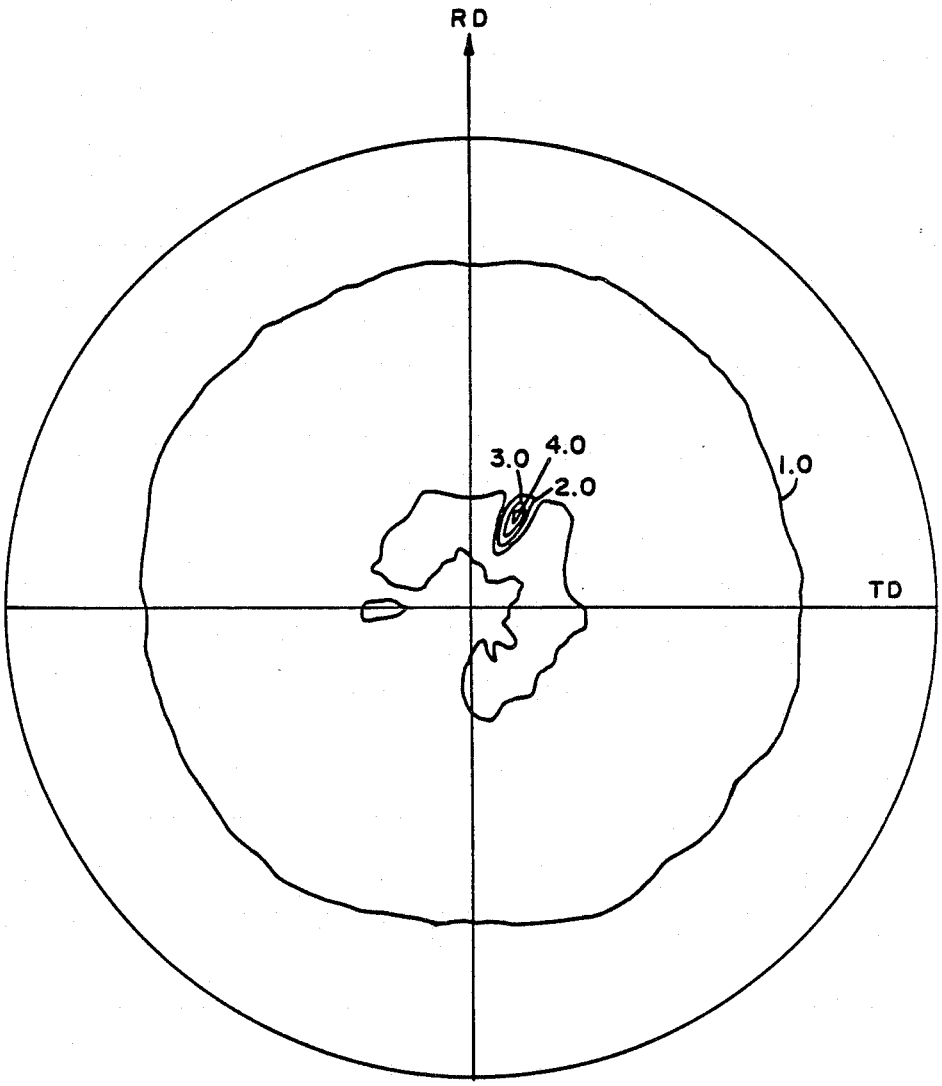

A strip was also cast on the apparatus using a Cu-Be substrate. The as-cast ribbon had a 100% columnar grain structure with an average grain diameter of $1.5\times10^{-5}$m, as shown in FIG. 14(*a*)(*b*). The texture analysis showed strong <200> (equivalent to <100>) fiber texture with intensity as high as 10 times random, plus a <211> component with intensity as high as 4 times random; FIGS. 9(*a*),(*b*).

Figure 10A:
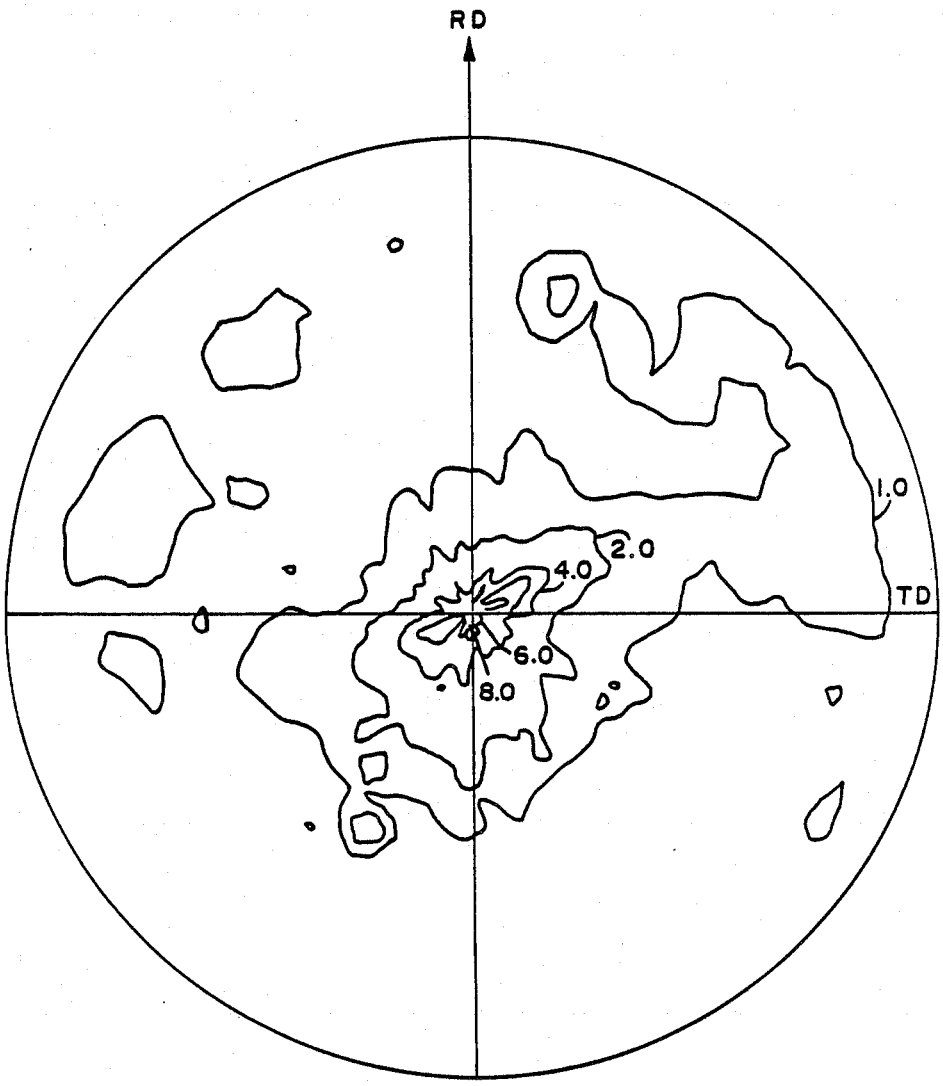
FIGS. 10(*a*),(*b*) show pole figures of a FeSi strip quenched on a Cu-Be substrate after pickling and annealing.
Figure 10B:
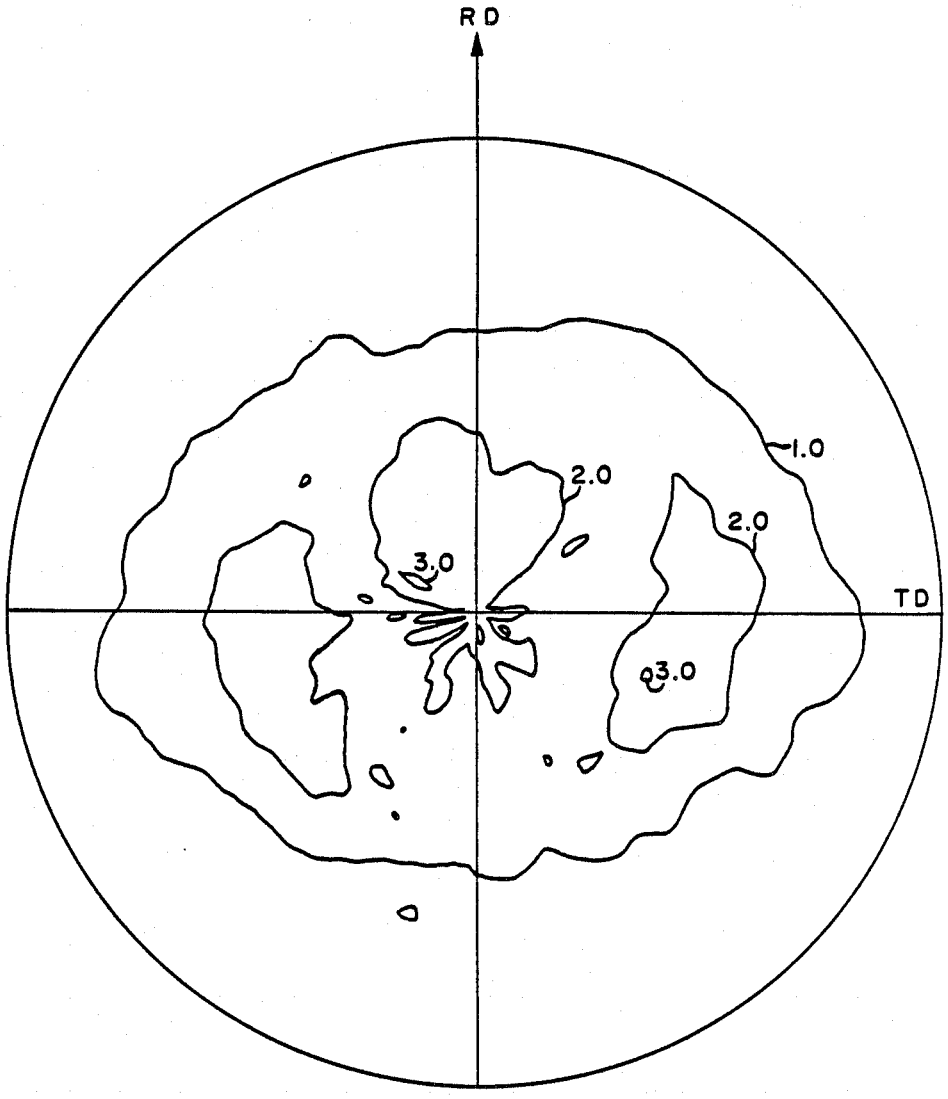

After annealing at 1120° C. for 2 hours in hydrogen atmosphere the sample had an average grain size of $7\times10^{-4}$m, and a <200> (equivalent to <100>) fiber texture with an intensity as high as 8 times random; FIGS. 10(*a*),(*b*).

As used in the specification and claims, the term "intensity" means the relative number of crystal grains having a particular crystal orientation compared to the number of grains having such a crystal orientation in a reference sample in which the grain crystals are randomly orientated. The intensity of a particular crystal orientation is determined by conventional techniques, such as X-ray diffraction and electron diffraction analysis. A suitable measuring device is a texture goniometer.

Figures 11A, 11B, 11C:
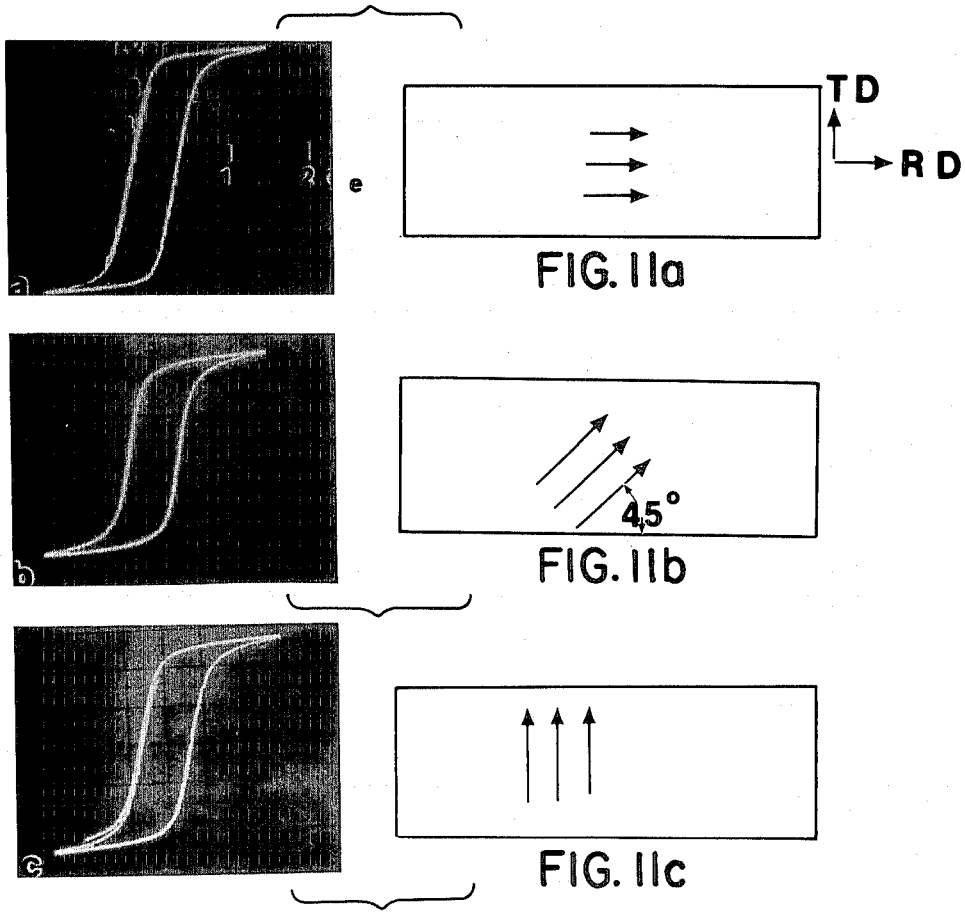
FIG. 11 shows B-H curves taken on the Fe-6.5 wt % Si strip of the present invention.

Since the final product had the fiber texture, the strip had magnetic properties that were substantially isotropic in the plane of the strip; (FIG. 11). At B=1.0 T, f=60 Hz the strip showed a core loss of approximately 0.46 W/kg and an exciting power of 0.62 VA/kg. FIG.

Figure 12A:
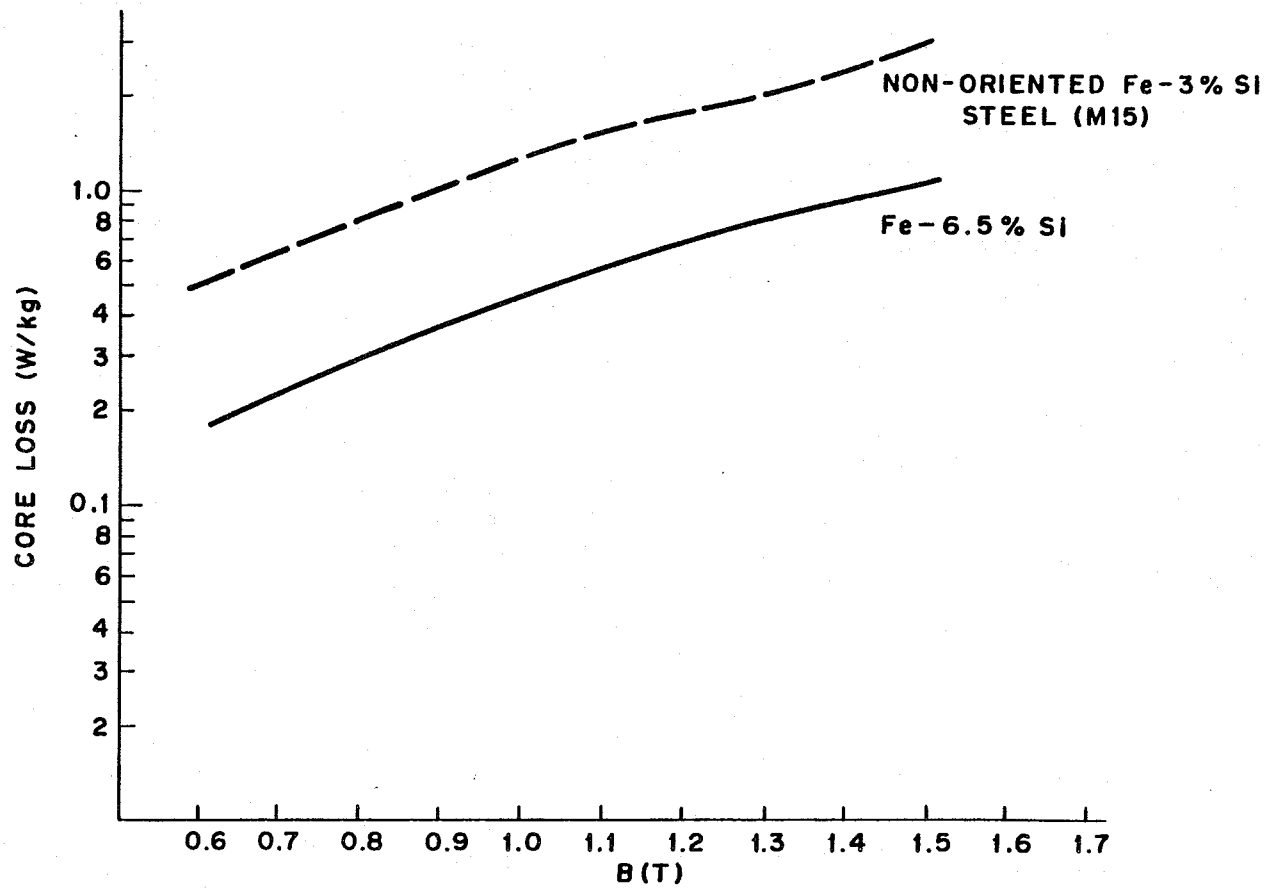
FIG. 12(*a*),(*b*) show magnetic properties of the strip of the present invention compared to the magnetic properties of non-oriented silicon steel.
Figure 12B:
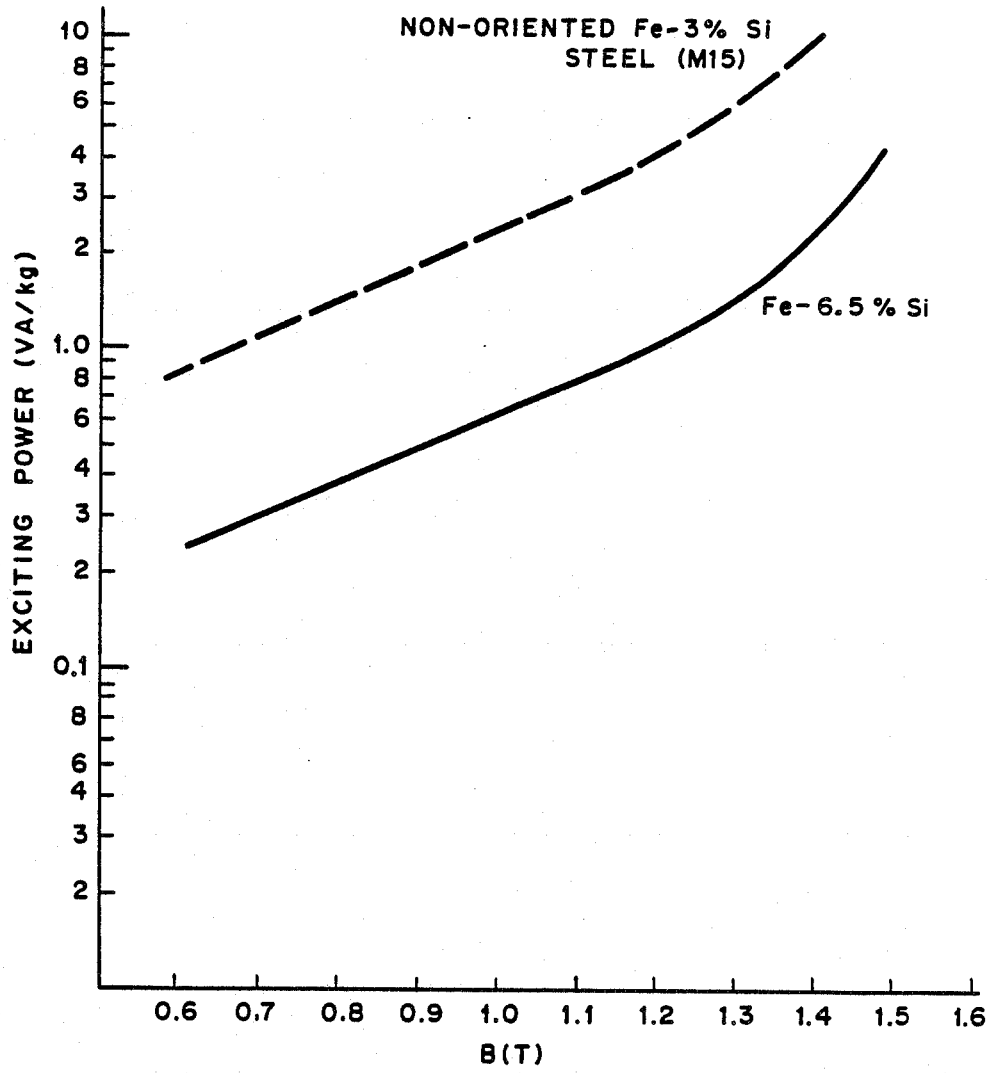

12(*a*) shows the average core loss of the strip material compared to a non-oriented electrical steel currently used in the motor application. FIG. 12(*b*) shows a comparison of the average exciting power of the strip material and non-oriented electrical steel. It can be clearly seen that the lower power loss and the isotropic nature of the improved strip material makes it a significant improvement over non-oriented silicon steel ordinarily employed in motor and generator applications.

Furthermore, the saturation magnetostriction of the FeSi material of the present invention is significantly reduced when compared to the magnetostriction of conventional materials commonly used in motor or generator applications. When a magnetic material is magnetized, its dimensions change slightly. The ratio of the change in the length in the direction parallel to the magnetization with respect to its original length is called magnetostriction, $\lambda$; i.e. $\lambda=\Delta 1/1$.

In a magnetic device, such as a transformer or a motor, subjected to an alternating magnetic field, the variation of the flux density, B, with respect to the coercive field, H, traces a hysteresis loop (See for example FIG. 12). At the same time, however, the variation of $\lambda$ with respect to H traces out a double loop because the magnetostriction strain is independent of the sense (direction) of the magnetization. The material therefore, vibrates at twice the frequency of the magnetic field to which it is subjected. This vibration is the major source of the humming sound emitted by transformers or motors. The vibrational movements can also degrade the magnetic characteristics of the material. To reduce the noise and improve the magnetic properties of the magnetic material, the magnetostriction should be minimized.

The metal strip of the invention has a saturation magnetostriction ranging from about 3 to 4 ppm (parts per million). In contrast, grain oriented Fe-3.2 wt % Si alloy has a saturation magnetostriction of 23 ppm, and polycrystalline iron with random texture has a saturation magnetostriction of 7 ppm.

Having thus described the invention in rather full detail, it will be understood that these details need not be strictly adhered to but that various changes and modifications may suggest themselves to one skilled in the art, all falling within the scope of the invention as defined by the subjoined claims.

We claim:

1. A method for casting a metal filament, comprising the steps of:

(a) supplying a stream of molten metal onto a casting surface of a moving chill body to form said filament;

(b) entraining said filament against said casting surface by employing a flexible, metallic mesh hugger belt to provide an entraining, hugger pressure which is sufficient to maintain said filament in cooling contact with said casting surface and is sufficient to substantially prevent relative movement of said filament with respect to said casting surface; and (c) controlling said flexible, metallic mesh hugger belt to prevent the application of a hugger pessure sufficient to induce excessive stresses within said filament during the cooling thereof.

2. A method as recited in claim 1, further comprising the steps of moving said chill body to provide a casting surface velocity ranging from about 100–4000 m/min.

3. A method as recited in claim 1, wherein the hugger pressure is at least about 0.5 psi.

* * * * *